US009226562B2

(12) United States Patent
Sauvage et al.

(10) Patent No.: US 9,226,562 B2
(45) Date of Patent: Jan. 5, 2016

(54) LIQUID PRODUCT DISPENSER

(75) Inventors: Anne-Sophie Sauvage, Paris (FR); Marc Delmon, Ytrac (FR)

(73) Assignee: Guerlain Societe Anonyme, Paris (FR)

( * ) Notice: Subject to any disclaimer, the term of this patent is extended or adjusted under 35 U.S.C. 154(b) by 0 days.

(21) Appl. No.: 14/123,668

(22) PCT Filed: Jun. 5, 2012

(86) PCT No.: PCT/FR2012/051250

§ 371 (c)(1),
(2), (4) Date: Dec. 3, 2013

(87) PCT Pub. No.: WO2012/168643

PCT Pub. Date: Dec. 13, 2012

(65) Prior Publication Data

US 2014/0097208 A1 Apr. 10, 2014

(30) Foreign Application Priority Data

Jun. 6, 2011 (FR) ..... 11 54909

(51) Int. Cl.

| | |
|---|---|
| ***A45D 34/00*** | (2006.01) |
| ***B05B 11/00*** | (2006.01) |
| ***A45D 34/04*** | (2006.01) |
| ***A45D 40/26*** | (2006.01) |

(52) U.S. Cl.

CPC ..... *A45D 34/00* (2013.01); *A45D 34/04* (2013.01); *A45D 40/26* (2013.01); *B05B 11/0027* (2013.01); *B05B 11/0035* (2013.01); *B05B11/0037* (2013.01); *B05B 11/0059* (2013.01); *B05B 11/3015* (2013.01); *B05B 11/3052* (2013.01); *A45D 2200/055* (2013.01); *A45D 2200/056* (2013.01); *A45D 2200/057* (2013.01); *B05B 11/0048* (2013.01)

(58) Field of Classification Search

CPC ..... B05B 11/0027; B05B 11/0035; B05B 11/0048; B05B 11/3015; A45D 34/00

USPC ..... 222/78, 160, 162, 182, 183, 320, 501, 222/559, 321.1–321.9; 401/152, 171, 176, 401/179

See application file for complete search history.

(56) References Cited

U.S. PATENT DOCUMENTS 2,637,466 A * 5/1953 Wright ..... 222/80
3,144,005 A * 8/1964 Johmann ..... 401/103

(Continued)

FOREIGN PATENT DOCUMENTS

| | | |
|---|---|---|
| EP | 0 349 416 A1 | 1/1990 |
| EP | 0 553 021 A1 | 7/1993 |
| EP | 0 858 747 A2 | 8/1998 |

OTHER PUBLICATIONS

International Search Report from related International Application No. PCT/FR2012/051250; report dated Aug. 7, 2012.

*Primary Examiner* — Paul R Durand
*Assistant Examiner* — Vishal Pancholi
(74) *Attorney, Agent, or Firm* — Miller, Matthias & Hull LLP

(57) ABSTRACT

The invention relates to a liquid product dispenser including a tank, a dispensing head mounted at one end of the tank, said dispensing head comprising an outlet nozzle, an outer shell containing the tank, and a driving part which is capable of axially moving the tank and which is mounted so as to be rotatable between a storage position and a use position. The outlet nozzle has an outlet oriented in the longitudinal direction, and is suitable for axially engaging with a portion that is rigidly connected to the outer shell during the actuation of the dispensing head in the use position of the dispenser, and the first end of the tank is connected to a pusher via a driving mechanism suitable for selectively retracting the pusher and the outlet nozzle into the outer shell, and for axially extracting same from the outer shell.

4 Claims, 10 Drawing Sheets

(56) References Cited

U.S. PATENT DOCUMENTS 3,186,416 A * 6/1965 Kolts ..... 401/179
3,830,404 A * 8/1974 Frazer ..... 222/78
5,011,317 A * 4/1991 Gueret ..... 401/66
5,096,319 A * 3/1992 Gueret ..... 401/126
5,536,249 A * 7/1996 Castellano et al. ..... 604/65
5,951,185 A * 9/1999 Kingsford et al. ..... 401/99
6,336,761 B1 * 1/2002 Kudo ..... 401/106
7,086,796 B2 * 8/2006 Severa ..... 401/179
7,794,166 B2 * 9/2010 Zhang ..... 401/179

* cited by examiner

LIQUID PRODUCT DISPENSER

CROSS-REFERENCE TO RELATED APPLICATIONS

This application is a 35 USC §371 U.S. national stage filing of International Patent Application No. PCT/FR2012/051250 filed on Jun. 5, 2012, and claims priority under the Paris Convention to French Patent Application No. FR 11 54909 filed on Jun. 6, 2011.

FIELD OF THE DISCLOSURE

The present invention relates to liquid product dispensers.

BACKGROUND OF THE DISCLOSURE

More particularly, the invention concerns a liquid product dispenser comprising:

- a reservoir (also referred to herein as a "tank") suitable for containing a product which is more or less liquid, and extending in a longitudinal direction between first and second ends,
- a dispensing head mounted at the second end of the reservoir, said dispensing head comprising an outlet nozzle which can be actuated in the longitudinal direction to dispense the liquid product,
- an outer shell within which the reservoir is mounted so as to slide axially in the longitudinal direction,
- a driving part mounted to rotate relative to the outer shell and capable of moving the reservoir axially between a storage position where the outlet nozzle is retracted into the outer shell, and a use position where the outlet nozzle is at least partially protruding from the outer shell.

Document EP-A-1 954 596 describes an example of such a distributor, which has the following disadvantages: the direction the product is released by the outlet nozzle can be mismanaged by the user, and the user can place his fingers in front of the outlet nozzle which interferes with the distribution of product.

The present invention is intended to overcome these disadvantages.

SUMMARY OF THE DISCLOSURE

In the invention, a distributor of the type in question is characterized in that:

- the outlet nozzle has an outlet oriented in the longitudinal direction and is suitable for axially engaging with a portion, rigidly connected to the outer shell, during the actuation of the dispensing head in the use position of the dispenser,
- and in that the first end of the reservoir is connected to a pusher by a driving mechanism suitable for selectively retracting the pusher and the outlet nozzle into the outer shell to the storage position and for axially extending said pusher and outlet nozzle from the outer shell to the use position.

By these arrangements, the dispenser operates similarly to a pen by pressing on the pusher as opposed to the dispensing nozzle, which allows the user to orient the distribution of liquid product with great precision, and in general prevents the user from placing his or her fingers over the outlet nozzle.

In various embodiments of the dispenser according to the invention, one or more of the following arrangements may be used:

- the first end of the reservoir is secured to an annular control part centered on the longitudinal direction, which comprises at least one helical groove into which at least one pin integral with the pusher is slidably mounted, said control part being mounted to slide axially and remain immobilized rotationally relative to the outer shell, and the pusher being secured rotationally relative to the driving part and mounted to slide axially relative to the driving part and relative to the outer shell, said pusher being adapted to abut axially against a portion of the outer shell in the use position;
- the driving mechanism further comprises an annular bearing which is securely attached to the outer shell and which cooperates with the driving part to limit the angular movement of said driving part relative to the outer shell;
- the reservoir contains a perfume or a cosmetic and/or personal care composition, particularly in the form of an emulsion or a gel.

Other features and advantages of the invention will become apparent from the following description of one of its embodiments, given by way of non-limiting example, with reference to the accompanying drawings.

BRIEF DESCRIPTION OF THE DRAWINGS

In the drawings:

FIG. 3 is an exploded view of the dispenser of FIGS. 1 and 2, FIGS. 3A and 3B are detailed views of FIG. 3, respectively showing the front and rear of the dispenser, FIGS. 3, 3A and 3B, FIGS. 5-9 are cross-sections of the dispenser in FIGS. 1 to 4, respectively along lines V-V, VI-VI, VII-VII, VIII-VIII, and IX-IX in FIG. 2.

In the various figures, the same references designate identical or similar elements.

DETAILED DESCRIPTION OF THE DISCLOSURE

Figure 1:
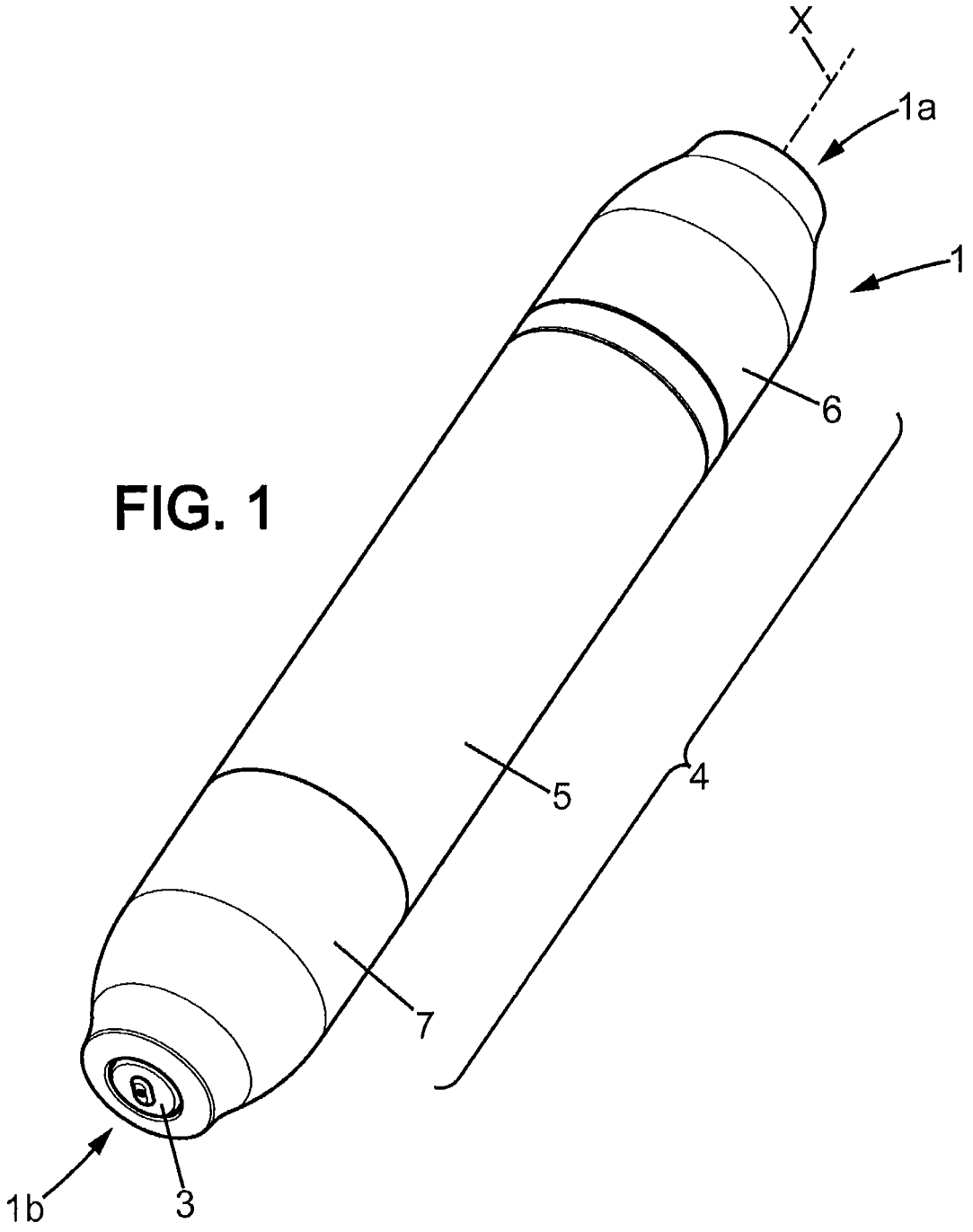
FIG. 1 is a perspective view of a liquid product dispenser according to one embodiment of the invention, in the storage position.
Figure 2:
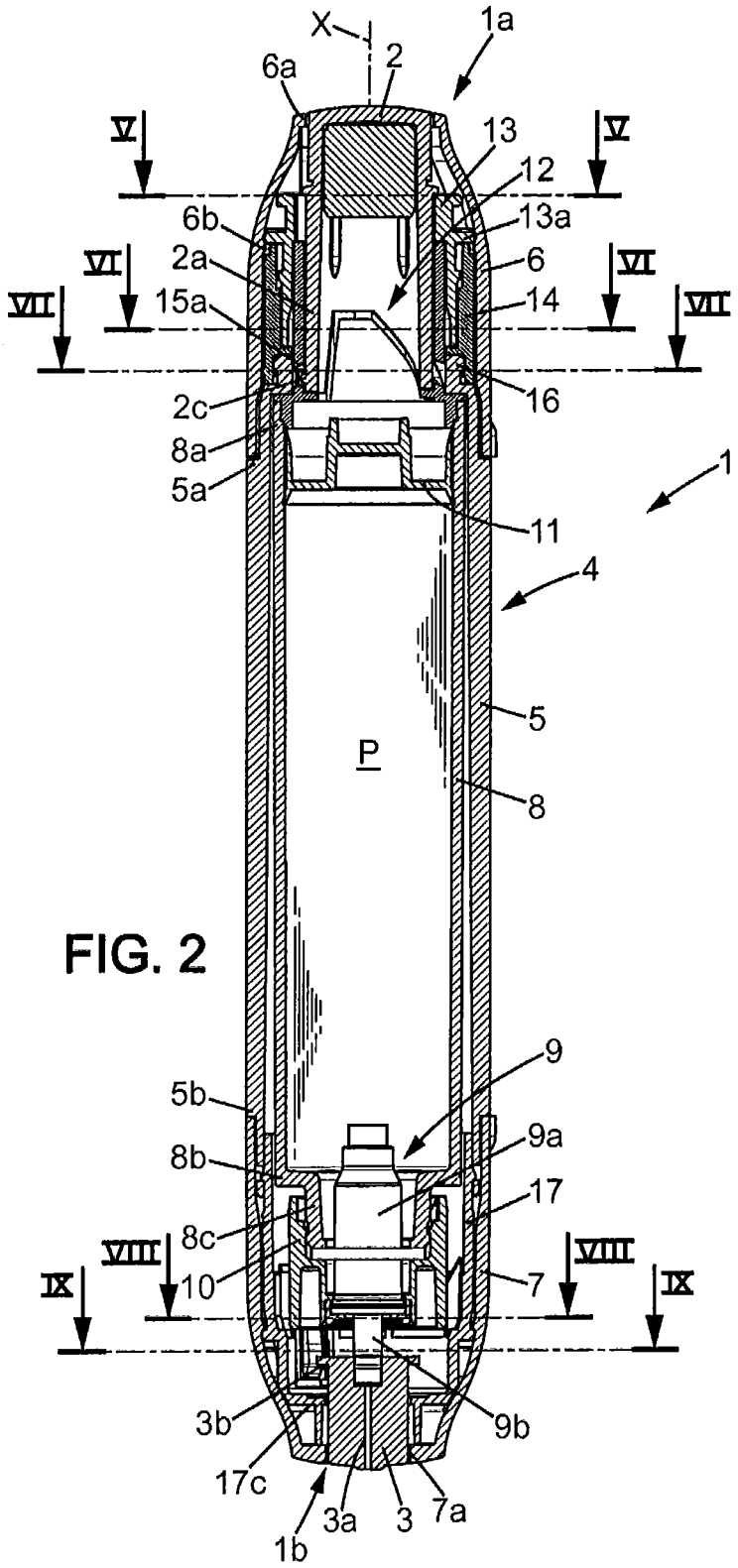
FIG. 2 is a longitudinal sectional view of the dispenser of FIG. 1, in the storage position.
Figure 3A:
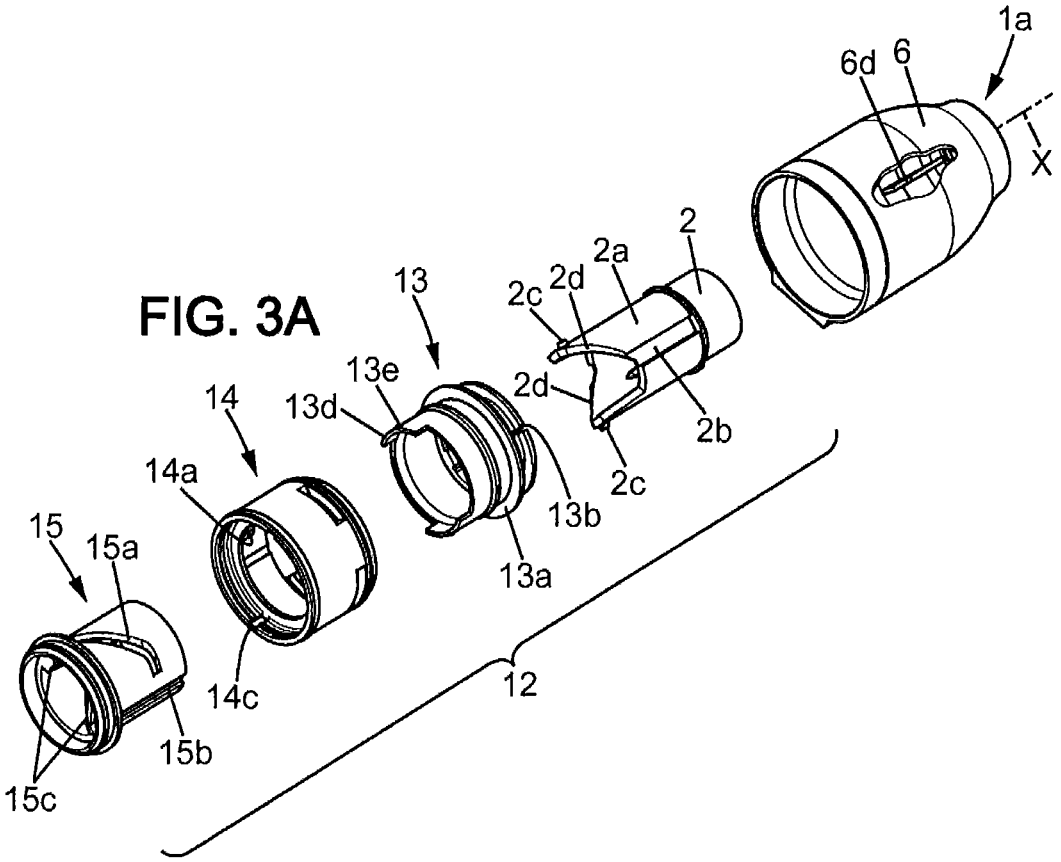
Figure 3B:
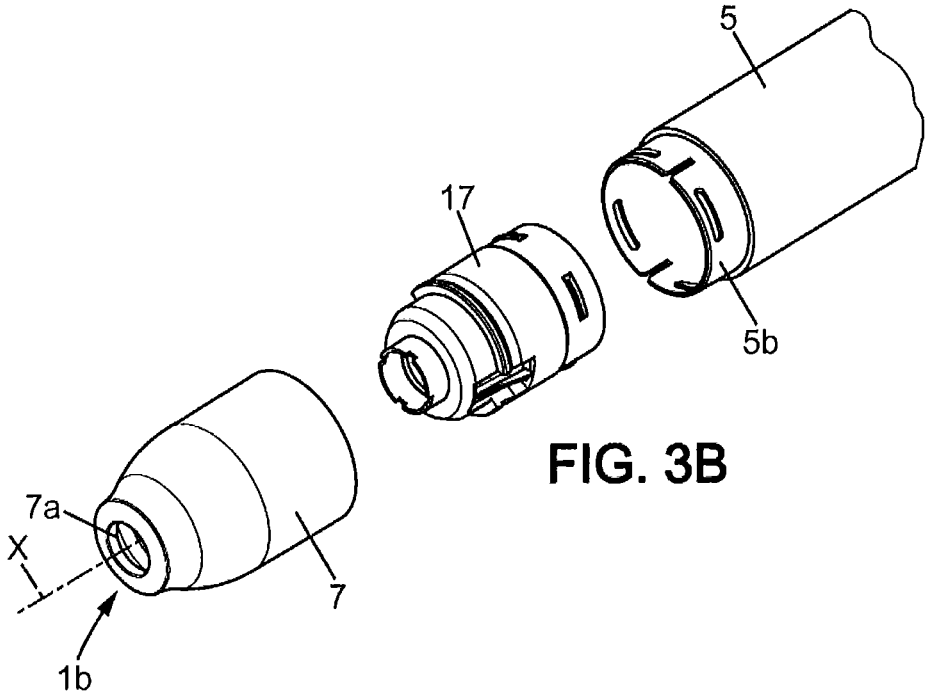

As shown in FIG. 1, the liquid product dispenser 1 according to the invention may be, for example, in a form similar to a pen, extending in a longitudinal direction X between a first end 1*a* equipped with a pusher 2 (see FIGS. 1 and 2) and a second end 1*b* equipped with an outlet nozzle 3 for dispensing the product. The dispenser 1 comprises a front portion A in the vicinity of the first end 1*a* and a rear portion B in the vicinity of the second end 1*b*. In the storage position represented in FIGS. 1 and 2, the pusher 2 and the nozzle 3 are retracted within an outer shell 4 having a general shape that is substantially cylindrical and that extends along the longitudinal direction X to form the barrel of the pen.

In general, the component parts of the dispenser 1 can be made for example of molded plastic; this feature will not be repeated below for each of these parts.

As shown in FIGS. 2 to 4B, the outer shell 4 of the dispenser may include for example:

- a substantially cylindrical central body 5, which extends in the longitudinal direction X between an end 5*a* near the first end 1*a* of the dispenser and an end 5*b* near the second end 1*b* of the dispenser,
- a first end piece 6 which is rotationally mounted on end 5*a* of the central body 5 so as to pivot about the longitudinal direction X between the storage position and the use position, this first end piece 6 having a circular opening 6*a* which faces away from the central body 5 in the longitudinal direction X and which the pusher 2 is retracted into when in the storage position,
- a second end piece 7 which is fitted into end 5*b* of the central body 5 to secure it (simple force-fitting, or fitting supplemented by gluing or welding), this second end piece also having a circular opening 7*a* which faces away from the main body 5 in the longitudinal direction X and which the nozzle 3 is retracted into when in the storage position.

The central body 5 contains a product reservoir 8 that is generally cylindrical in shape, extending in the longitudinal direction X between an end 8*a* near the first end piece 6 and an end 8*b* near the second end piece 7. This product reservoir 8 is filled with liquid product P to be dispensed, which is more or less viscous as required. The liquid product concerned may be a perfume, or a cosmetic and/or personal care product, particularly in the form of an emulsion or gel, a pharmaceutical product, or some other product.

In the example considered here, end 8*a* of the reservoir 8 is open, while end 8*b* of the reservoir is extended by a neck 8*c* on which is mounted a dispensing head 9 such as a manual pump or a similar arrangement.

The dispensing head 9 includes (see FIG. 2):

- a body 9*a* which is secured to the neck 8*c* of the reservoir, for example by means of a mounting ring 10 snapped onto the neck 8*c*, or by any other means,
- and an actuating rod 9*b* mounted to slide within the body 9*a* in the longitudinal direction X, this actuator rod 9*b* being hollow and inserted into the outlet nozzle 3 of the dispenser, said nozzle having at least one axially emptying channel 3*a* in communication with the actuator rod 9*b* to allow the release of product P when the dispenser is actuated, as will be explained below.

In the present case, the reservoir 8 is further enclosed by a piston 11 mounted to slide within the reservoir in direction X in order to define an enclosed volume filled with the liquid product P. In the present case, the dispensing head 9 operates without any air intake, meaning that it does not allow air to enter the product reservoir 8 as the liquid product P is distributed: the piston 11 moves toward the second end 8*b* of the reservoir as the liquid product P is consumed.

Alternatively, the product reservoir 8 could be pressurized and the dispensing head 9 could be a valve. For example, a pressurized reservoir could be used when the product P is a cosmetic product such as foundation.

The first end piece 6 further comprises a control mechanism 12, clearly visible in FIGS. 2, 3, 3A, 4 ,4A and 5 to 7. This control mechanism comprises a driving part 13, a bearing 14, and a control part 15.

The driving part 13 has an annular shape centered on direction X. This driving part 13 is retained axially inside the first end piece 6, for example by snap-fitting a flange 13*a* of the driving part into an inner ring 6*b* in the first end piece (see FIG. 2), and said driving part is also rotationally integral with the first end piece 6, for example by fitting axial ribs 6*d* of the first end piece into axial notches 13*b* of the driving part (see FIGS. 3A and 5).

Figure 4:
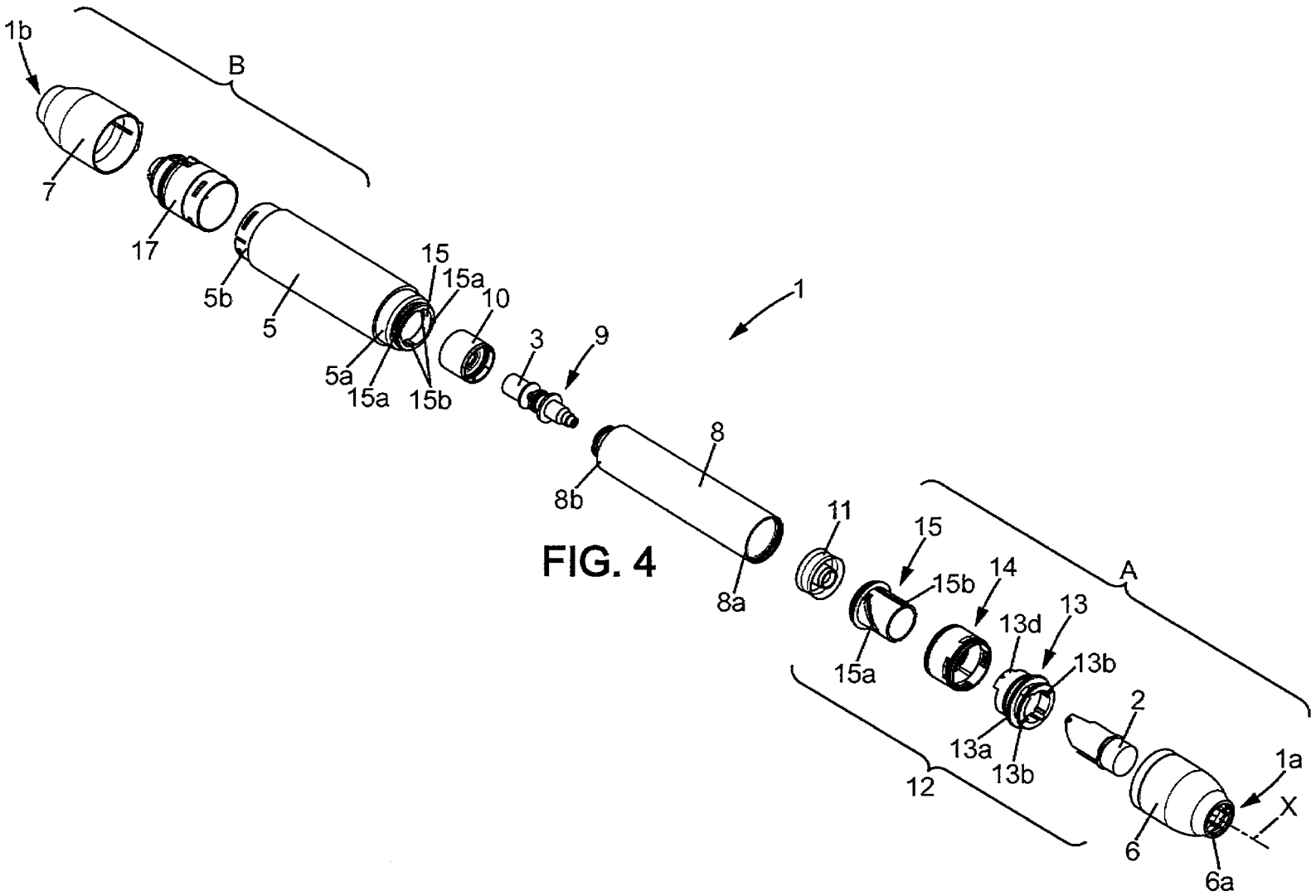
FIGS. 4, 4A and 4B are views similar to FIGS. 3, 3A, and 3B, showing the dispenser viewed from a direction substantially opposite
Figure 4A:
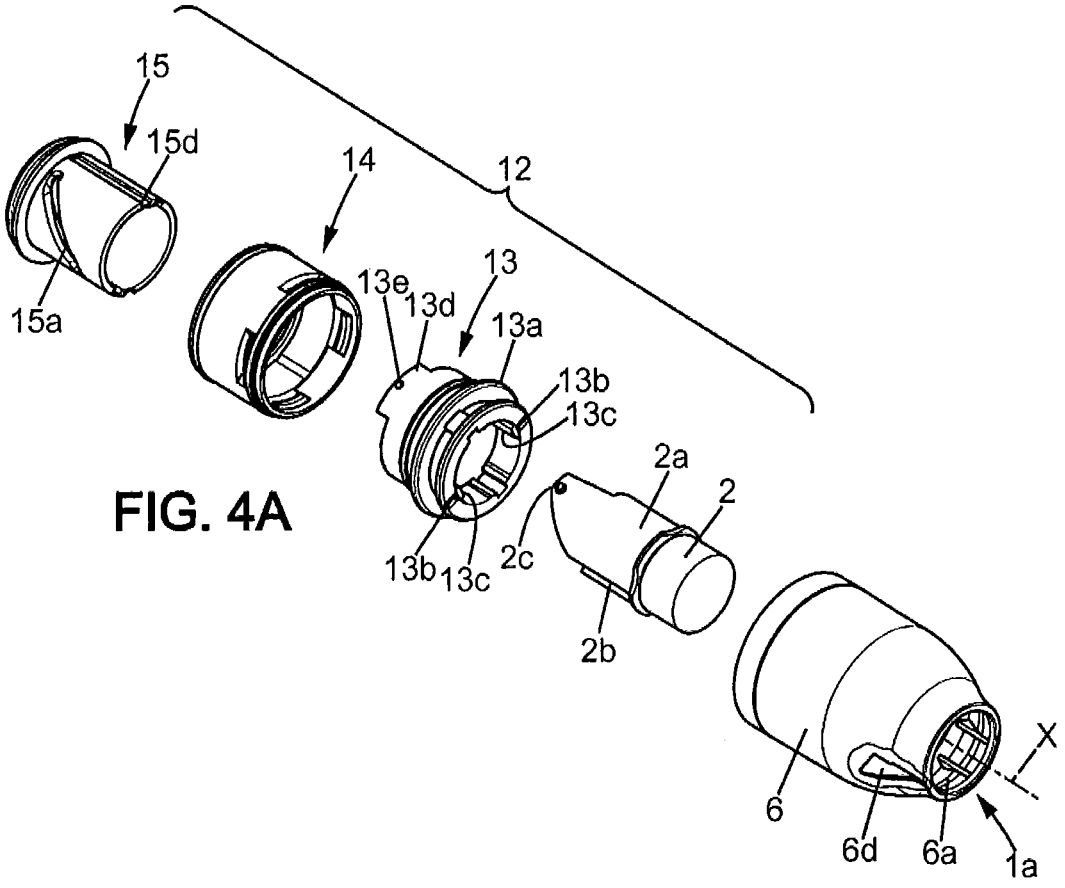
Figure 4B:
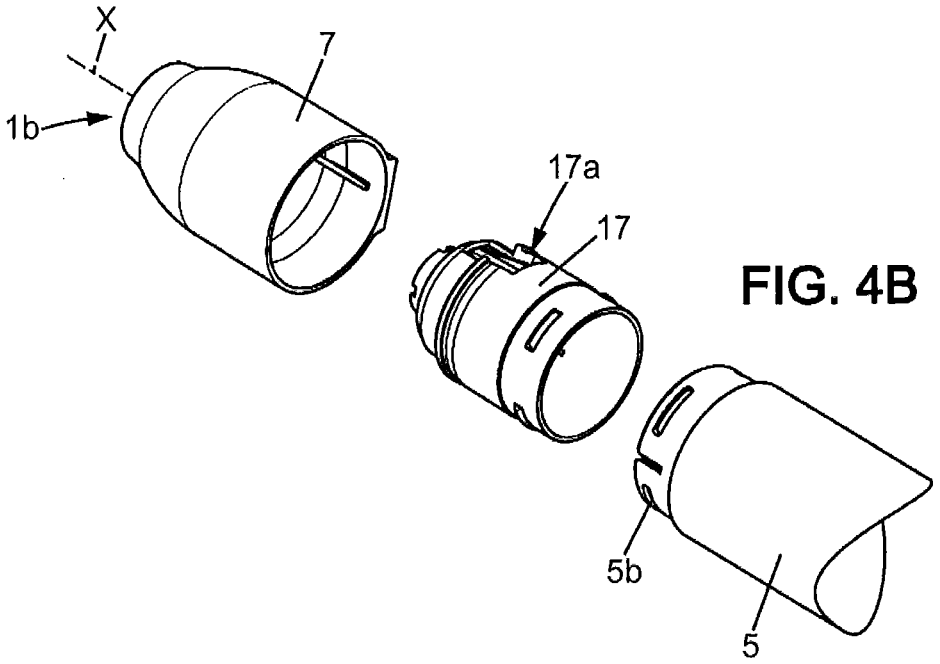
Figure 5:
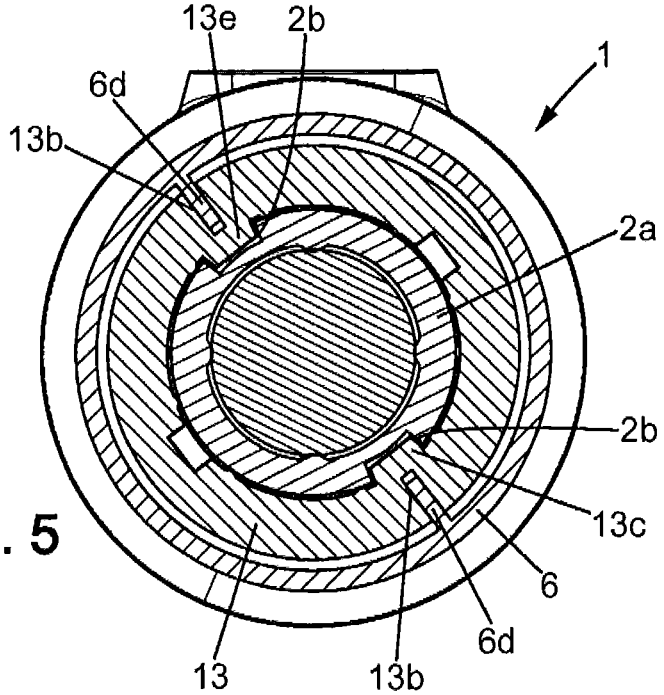
Figure 6:
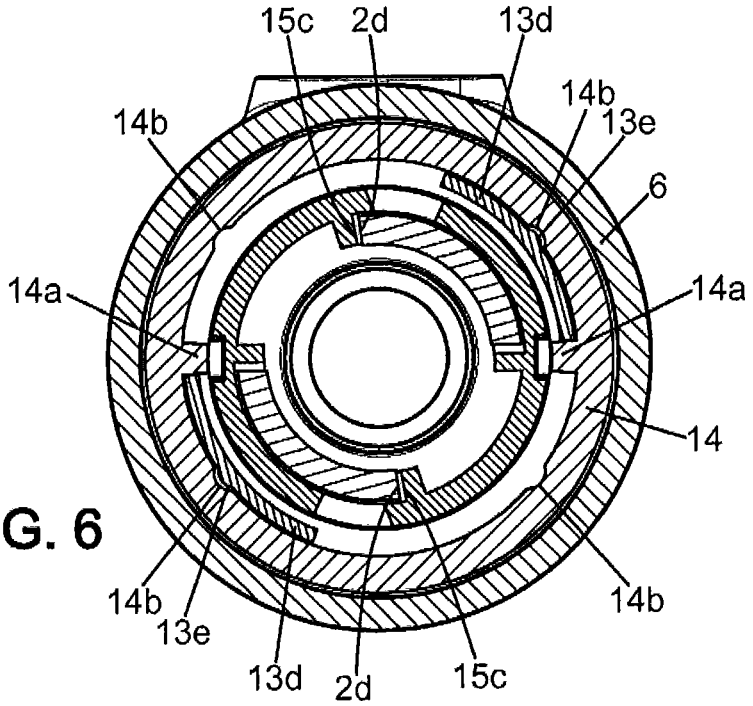
Figure 7:
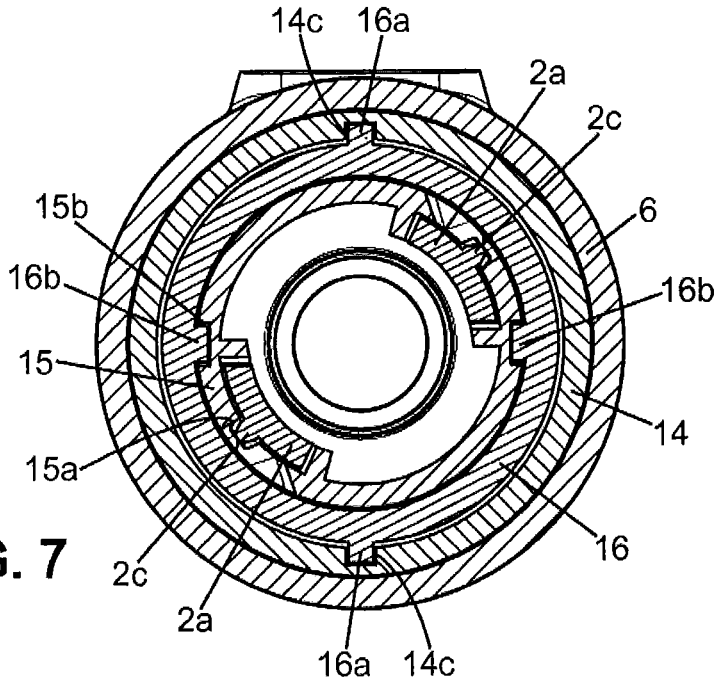
Figure 8:
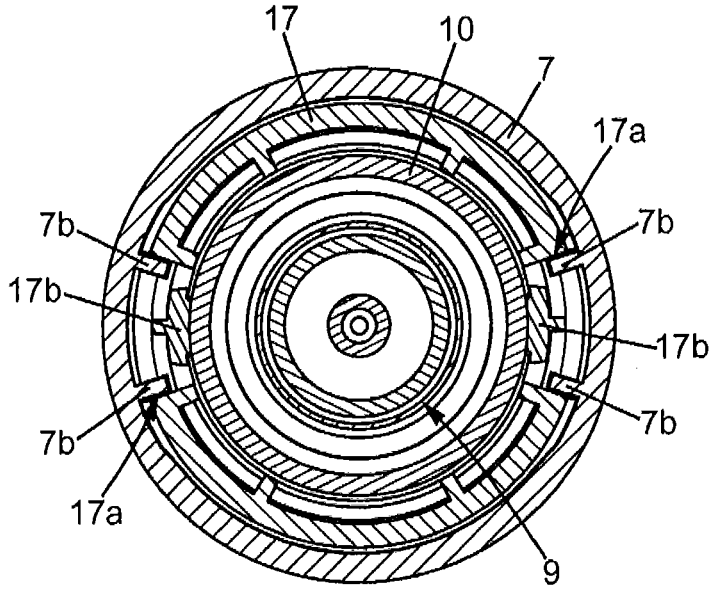
Figure 9:
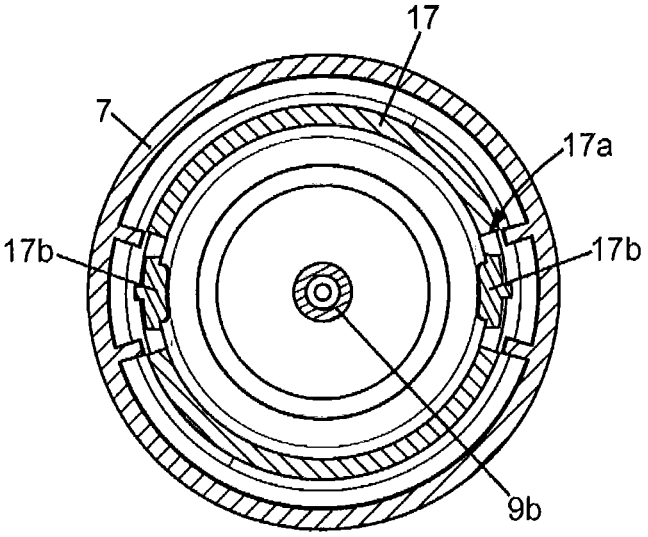

In addition, as shown in particular in FIGS. 4A and 5, the driving part 13 is rotationally integral with the pusher 2, for example by means of internal axial ribs 13*c* (or other reliefs) of the control part 13, which extend along direction X and enter axial grooves 2*b* arranged on the exterior of an axial skirt 2*a* that is part of the pusher 2 and which extends in direction X towards the reservoir 8 and through the driving part. However, the pusher 2 is not connected axially to the driving part, so that it can move axially along direction X relative to the driving part 13, as will be explained below.

The bearing 14 is also an annular part centered on direction X, and is arranged around the driving part 13. As can be seen in particular in FIGS. 3A and 6, the bearing 14 is connected to the driving part 13 in a manner that allows rotational movement of said control part 13 with the first end piece 6 over a limited angle of movement. The limitation of this angle of movement can be obtained by any known means, for example by two pins 14*a* shaped inside the bearing 14, which cooperate by engaging with two teeth 13*d* of the driving part, these teeth extending axially towards the reservoir 8. The angle of movement allowed for the driving part and the first end piece 6, between the storage position and the use position, can thus be on the order of a third of a turn for example.

Indexing means may also be provided for retaining the control part 13 and the first end piece 6 in either the storage position or the use position. In the example represented, the indexing means may include two bosses 13*e* respectively protruding from the two teeth 13*d* of the control part, the bosses fitting into respective recesses 14*b* in the bearing 14 when in the rest position and use position.

As shown in FIGS. 2, 3A, 4 and 7, the bearing 14 is also secured to a neck 16 formed at end 5*a* of the body 5:

- axially, by snap-fitting the neck 16 into the bearing 14,
- and rotationally, for example by engaging external axial ribs 16*a* of the neck 16 with internal axial grooves 14*c* of the bearing.

As can be seen in particular in FIGS. 2, 3, 3A, 4, 4A and 7, the control part 15 is an annular piece centered on direction X, arranged around the skirt of the pusher 2 and secured to the end 8*a* of the reservoir 8 by snap-fitting or other means.

This control part 15 has two helical grooves 15*a*; external pins 2*c* formed at the free end of the skirt 2*a* of the pusher 2 fit into these grooves. The pusher 2 further comprises a lower edge 2*d* in the shape of a double helical ramp which slides on two internal helical grooves 15*c* of the control part 15, thus optionally and/or alternatively helping to guide the pusher 2 relative to the control part 15. In addition, the control part is rotationally integral with the main body 5, which is achieved for example by means of pins or inner ribs 16*b* of the neck 16, which engage with external axial grooves 15*b* of the control part 15.

Furthermore, as shown in particular in FIGS. 2, 3, 3B, 8, 9, the second end piece 7 is secured to the main body 5 by snap-fitting, and is rotationally integral with an inner ring 17, achieved for example by this inner ring pressing axially against the second end piece and by internal axial ribs 7*b* of the second end piece fitting into indentations 17*a* in the inner ring, these indentations 17*a* defining elastic tabs 17*b* laterally pressing against the mounting ring 10 mentioned above, such that the mounting ring 10 can slide axially within the inner ring 17 along direction X.

The device described above operates as follows.

Figure 10:
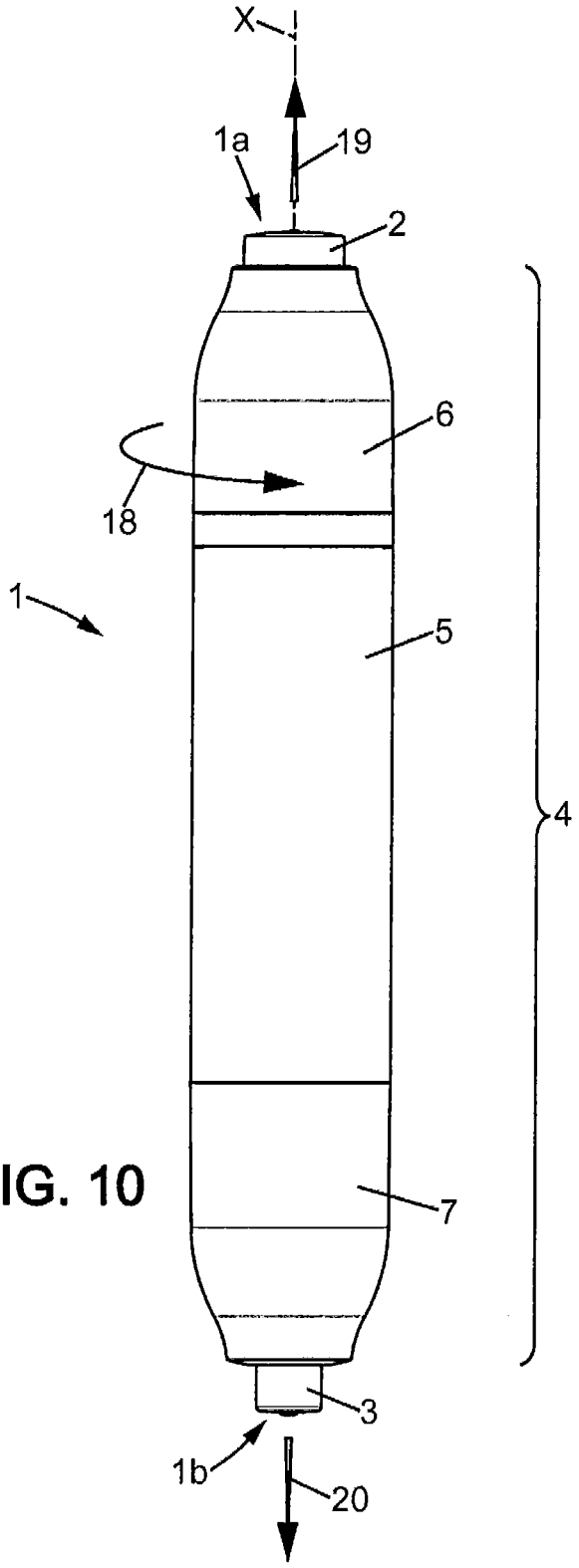
FIG. 10 is a side view showing the dispenser of FIGS. 1-4 in the use position.
Figure 11:
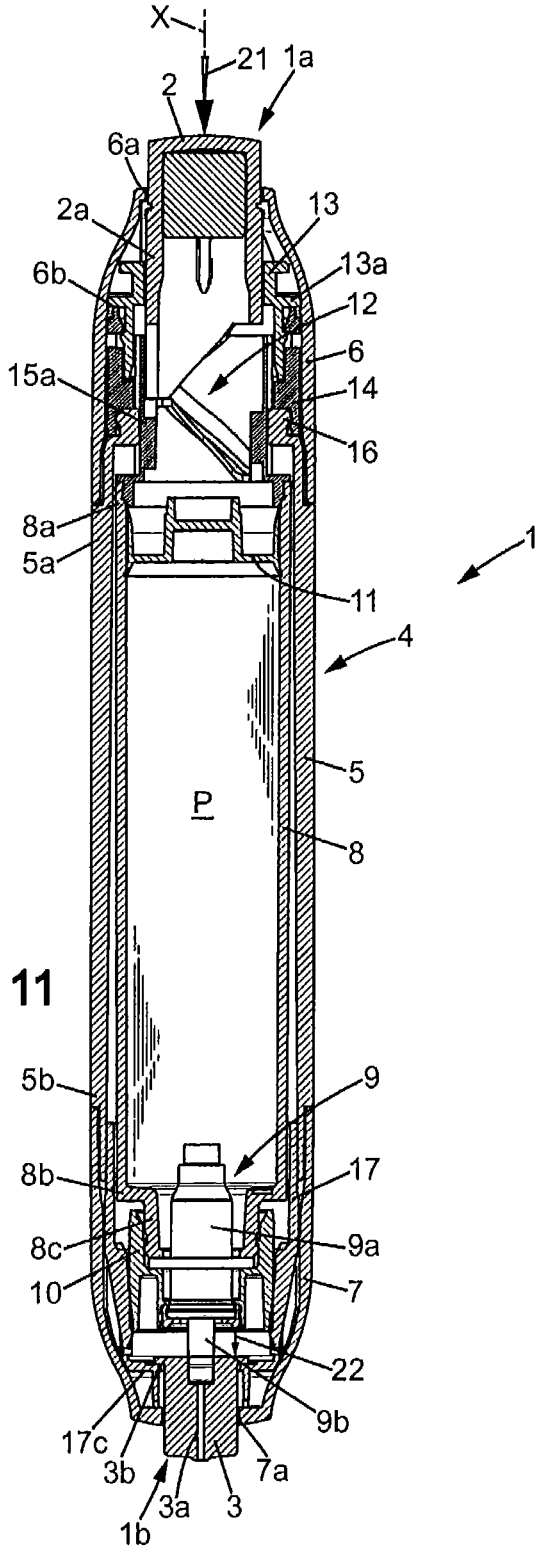
FIG. 11 is a longitudinal sectional view of the dispenser of FIG. 10, in the use position.

When a user rotates the first end piece 6 relative to the main body 5 in the direction of arrow 18 visible in FIG. 10, this rotation also rotates the driving part 13, which causes the pusher 2 to rotate due to the ribs 13*c* of the driving part entering the grooves 2*b* of the pusher. Because of this, the pins 2*c* of the pusher slide in the helical grooves 15*a* of the control part, which is rotationally integral with the main body 5. As a result, the pusher 2 protrudes from the first end piece 6 in the direction of arrow 19 (FIG. 10), and when the pusher reaches the position where it is pressing axially against the first end piece 6, the rotation of the pusher 2 causes the control part 13 to slide within the neck 16 towards the second end piece 7, which also drives the reservoir 8 in the same direction, such that the nozzle 3 projects from the second end piece 7 in the direction of arrow 20 (FIG. 10).

When the user next wishes to use the dispenser 1 to dispense a dose of liquid P, the user presses the pusher 2, which also moves the reservoir 8 and pump 9 towards the second end piece 7, causing the mounting ring 10 to slide within the elastic tabs 17*b* of the inner ring while the nozzle is locked in place translationally, for example by an external shoulder 3*b* of said nozzle pressing against a narrowing 17*c* of the inner ring 17. As a result, the rod 9*b* of the pump enters the body 9*a* of said pump, actuating the pump and causing the dose of substance P to be released.

Thus, a particularly precise distribution (particularly spray) of the dose of product P is achieved, with virtually no risk of a user placing their fingers over the nozzle 3. In addition, as the pusher is not near the nozzle 3, this reduces the potential for bacterial contamination of the product P via the nozzle opening 3*a*, where contamination can be introduced by fingers actuating the pusher. These arrangements are particularly advantageous when the reservoir 8 contains a product P which is not a perfume.

The invention claimed is:

1. A liquid product dispenser, comprising:

a reservoir suitable for containing a liquid product and extending in a longitudinal direction between first and second ends, a dispensing head mounted at the second end of the reservoir, said dispensing head having an outlet nozzle which is movably mounted with respect to the reservoir in the longitudinal direction and which is able to dispense the liquid product when said reservoir is moved toward said outlet nozzle while said outlet nozzle remains in place, an outer shell within which the reservoir is mounted so as to slide axially in the longitudinal direction, a pusher connected to the first end of the reservoir, and a driving mechanism having a driving part mounted to rotate relative to the outer shell and actuable by a user for selectively performing one of: retracting both the pusher and the outlet nozzle into the outer shell to a storage position, and axially extending both said pusher and outlet nozzle from the outer shell to a use position where said pusher and outlet nozzle are at least partially protruding from the outer shell, wherein the pusher, when actuated by a user in the use position, is able to push the reservoir toward the outlet nozzle and the outlet nozzle has an outlet oriented in the longitudinal direction and is suitable for axially engaging with a portion, rigidly connected to the outer shell in the use position, so that when the pusher is actuated, the reservoir is moved toward the outlet nozzle while said outlet nozzle remains in place, to acutate the dispensing head thus dispenses said liquid product.

2. A liquid product dispenser, comprising:

a reservoir suitable for containing a liquid product and extending in a longitudinal direction between first and second ends, a dispensing head mounted at the second end of the reservoir, said dispensing head comprising an outlet nozzle which can be actuated in the longitudinal direction to dispense the liquid product, an outer shell within which the reservoir is mounted so as to slide axially in the longitudinal direction, a driving part mounted to rotate relative to the outer shell and capable of moving the reservoir axially between a storage position where the outlet nozzle is retracted into the outer shell, and a use position where the outlet nozzle is at least partially protruding from the outer shell, wherein the outlet nozzle has an outlet oriented in the longitudinal direction and is suitable for axially engaging a portion that is rigidly connected to the outer shell during actuation of the dispensing head in the use position of the dispenser, and wherein the first end of the reservoir is connected to a pusher by a driving mechanism suitable for selectively retracting the pusher and the outlet nozzle into the outer shell to the storage position and for axially extending said pusher and outlet nozzle from the outer shell to the use position, wherein the first end of the reservoir is secured to an annular control part centered on the longitudinal direction, which comprises at least one helical groove into which at least one pin integral with the pusher is slidably mounted, said control part being mounted to slide axially and remain immobilized rotationally relative to the outer shell, and the pusher being secured rotationally relative to the driving part and mounted to slide axially relative to the driving part and relative to the outer shell, said pusher being adapted to abut axially against a portion of the outer shell in the use position.

3. The dispenser according to claim 2, wherein the driving mechanism further comprises an annular bearing which is securely attached to the outer shell and which cooperates with the driving part to limit the angular movement of said driving part relative to the outer shell.

4. The dispenser according to claim 1, wherein the reservoir contains a product which is a perfume or a cosmetic and/or personal care composition, particularly in the form of an emulsion or gel.

* * * * *